US008235199B2

(12) United States Patent
Illedits et al.

(10) Patent No.: US 8,235,199 B2
(45) Date of Patent: Aug. 7, 2012

(54) HANDRAIL FOR AN ESCALATOR OR A MOVING WALKWAY

(75) Inventors: Thomas Illedits, Österreich (AT); Thomas Novacek, Österreich (AT); Michael Matheisl, Österreich (AT)

(73) Assignee: Inventio AG, Hergiswil NW (CH)

( * ) Notice: Subject to any disclaimer, the term of this patent is extended or adjusted under 35 U.S.C. 154(b) by 0 days.

(21) Appl. No.: 12/993,553

(22) PCT Filed: May 5, 2009

(86) PCT No.: PCT/EP2009/055432

§ 371 (c)(1), (2), (4) Date: Nov. 19, 2010

(87) PCT Pub. No.: WO2009/141226

PCT Pub. Date: Nov. 26, 2009

(65) Prior Publication Data

US 2011/0067974 A1 Mar. 24, 2011

(30) Foreign Application Priority Data

May 21, 2008 (EP) ..... 08156610
May 21, 2008 (EP) ..... 08156620

(51) Int. Cl.
*B66B 23/24* (2006.01)

(52) U.S. Cl. ..... 198/337; 198/335; 198/844.2

(58) Field of Classification Search ..... 198/335, 198/336, 337, 338, 844.2; 474/253, 255
See application file for complete search history.

(56) References Cited

U.S. PATENT DOCUMENTS 4,279,676 A * 7/1981 Morrison et al. ..... 156/159
4,776,446 A * 10/1988 Fisher et al. ..... 198/337
4,852,713 A * 8/1989 Tatai et al. ..... 198/337
5,160,009 A * 11/1992 Iyoda et al. ..... 198/337
5,246,100 A * 9/1993 Stone et al. ..... 198/844.2
5,531,316 A * 7/1996 Savino ..... 198/844.2
7,083,037 B2 * 8/2006 Durrer et al. ..... 198/335
7,200,915 B2 * 4/2007 Keun ..... 29/527.1
7,650,981 B2 * 1/2010 Guo et al. ..... 198/337
7,802,670 B2 * 9/2010 Durrer et al. ..... 198/337
7,815,043 B2 * 10/2010 Hawkins et al. ..... 198/847

* cited by examiner

*Primary Examiner* — Douglas Hess
(74) *Attorney, Agent, or Firm* — Ladas & Parry LLP

(57) ABSTRACT

A handrail has an outer shell at least partially coated with at least one layer of a metal and/or at least one metal compound, and is formed of a plurality of interconnected grip elements located on a power transmission chain or belt. Ends of adjacent grip elements can be pushed inside each other, allowing the grip elements to tilt with respect to each other, particularly in bent or curved sections, without deforming the elements. Each grip element may have an interior chamber or recess which overlaps an external chamfer or recess of an adjacent grip element. The outer shell may be double walled with inner and outer walls

7 Claims, 3 Drawing Sheets

HANDRAIL FOR AN ESCALATOR OR A MOVING WALKWAY

The invention relates to a handrail, particularly a handrail for escalators or moving walkways. In particular, the invention relates to the field of handrails for escalators or moving walkways, which are operated outside and/or which are exposed to a high intensity of use.

BACKGROUND OF THE INVENTION

A device for guiding a multi-element handrail, as well as a multi-element drivable handrail, are known from DE 10316383 B4. The known handrail includes a base body, which co-operates with a guide profile member, and a plurality of individual elements, wherein the base body is provided with a plurality of outwardly facing elements of web-like construction. In that case, the individual elements are in operative connection with one another. Moreover, the elements are provided in their inner regions remote from the webs with projections by way of which a mechanically positive connection with a drive chain exists.

The handrail known from DE 10316383 B4 has the disadvantage that due to the numerous web-like outwardly facing elements it is possible for material, which can be removed only with difficulty, to collect in the intermediate spaces, for example, water, ice, sand, dust, soil, chemicals, food residues and contaminants. Moreover, there is the risk of damage to the surface of the handrail over the period of use by chemical or mechanical actions.

A handrail for escalators or moving walkways is known from WO 2006/010181 A2, wherein the grip element has a coated outer shell. This handrail is of integral construction and therefore has to be resiliently bent on a circular path in the deflection region (between forward run and return run). The coating has to accommodate this bending, so that only resilient coatings are possible such as, for example, on a polyurethane resin basis A handrail for an escalator or a moving walkway is known from WO 91/04219, which consists of individual segments. In that case, a respective section of steel cables is injection-moulded around by a thermoplastic elastomer, wherein the steel cables are tightened during the injection-moulding. Thus, the individual segments lie with bias against one another in the finished handrail. In this handrail as well, deformations arise in the deflection region, the size of the deformations depending on the ratio of the resilience of the steel cables to the resilience of the thermoplastic elastomer.

Such a handrail can also be coated only with a resilient material, since otherwise the coating splits or falls off or detaches.

BRIEF DESCRIPTION OF THE INVENTION

Technical Object

The object of the invention is to create a handrail which has an improved durability or repelling capability or water repulsion and which has, in particular specifically in a grip region, an improved surface or cover layer or casing.

The object is fulfilled by a handrail according to the invention comprising an at least partly coated outer shell wherein the coating applied to the outer shell is provided at least partly in a grip region the outer shell. The coating comprises at least one layer of a metal and/or a metal compound. The handrail is formed from a plurality of grip elements that are arranged on a traction means, wherein adjacent grip elements can be pushed into one another so that the grip elements are tiltable to a limited extent relative to one another.

Advantageous developments of the handrail include the use of mating bevels or recesses to adjacent grip elements to achieve tiltability, forming the outer shell with a double wall construction, and applying a coating with a carrier layer and a top layer. The layers may be applied by a variety of techniques.

Technical Solution and Advantageous Effects

Due to the fact that the handrail is formed from a plurality of grip elements which are arranged on a traction means, wherein adjacent grip elements can be pushed into one another, the grip elements are tiltable a little relative to one another and there are no elastic deformations of the individual grip elements in the deflecting region. It is therefore possible to coat the grip elements with a metal (for example with chromium) so that it gains a very hard, easily cleanable surface without fear of splitting or falling off or coming off due to repeated deformations.

In order to achieve the capability of displacement of the grip elements in one another or of tilting it is advantageous if each grip element has an inwardly disposed bevel or recess by which it engages over an outwardly disposed bevel or recess of the adjacent grip element. The individual grip elements, which are moved by a traction means (for example a chain), can thus freely move relative to one another within a certain extent so that they can follow the curve in the deflecting region without deformation.

It is advantageous if the coating comprises at least one layer of a metal and/or at least one metal compound. In that case the coating of metal or the metal compound can be applied by physical vapour deposition, by vacuum metallisation or by sputtering. In particular, use can be made of a PVD method or a PE-CVD-based method. Thus, a layer, which is suitable for the respective application or use case, of a metal advantageous for that purpose or an alloy with a metal advantageous for that purpose, can be employed.

It is advantageous if the metallic coating in the grip region of endgrip region is formed to be closed. A whole-area protection relative to mechanical or chemical damage can thereby be achieved. Obviously, the outer shell or cover layer or casing of the grip element or grip segment is then also formed to be closed at least in the grip region. Moreover, it is advantageous if the outer shell or cover layer or casing is formed to be substantially closed and non-porous or non-amorphous. Penetration of water, ice, sand, dust, soil, chemicals, food residues or contaminants is thereby effectively prevented. In addition, a closed surface of the outer shell or cover layer or casing is available for carrying a coating.

It is advantageous if the outer shell is of double-wall construction with an outer wall and an inner wall. A certain degree of resilience of the outer wall is thereby achieved so that, for example, in the case of differential temperature expansions a cracking or falling off or detaching of the coating can be prevented.

It is advantageous that the coating comprises a carrier layer, which is applied to an outer surface of the outer shell or cover layer, and a top layer, which is applied over the carrier layer. Specifically, the carrier layer can be applied by plating on the outer surface. For the plating, after a chemical pretreatment of the outer shell or cover layer, which can be formed from plastics material or plastics material compound, different metal layers are applied electrostatically and without charge. The adhesion or attachment or adherence or coupling is chemical and mechanical. Metal can thereby be deposited on the outer surface of the outer shell or cover layer, i.e. on the plastics material, by suitable chemicals in a continuous process.

An indirect metallisation in which an indirect application of a metal layer is carried out by use of a pre-metallised material is also advantageous. The metallisation of the carrier layer is carried out, for example, by vacuum metallisation. The carrier layer is then applied to a suitable surface by hot-film application or film stamping, an insert layer or directly in the mould.

The coating can also be applied or formed by galvanising. In that case, a base body with the outer shell or cover layer or casing of the grip element is etched in a chromium-sulphuric acid solution and subsequently activated or seeded or dusted or coated with a noble metal, particularly palladium. Moreover, a carrier layer can be applied to an outer surface by a chemical nickel coating through reductive deposition. A strike nickel or adhesion nickel as guide promoter can then be additionally deposited as a first electrolytic layer in order to build up the carrier layer. In addition, it is possible to apply by the electrolytic deposition a copper layer, a multiple nickel layer and/or a chromium layer as intermediate layer or also as top layer. In that case, a plurality of part layers can be provided. Plating of plastics material surfaces has the advantage that important product characteristics such as, for example, electromagnetic compatibility or ultraviolet-light resistance or ozone resistance can be favourably influenced.

Reference is expressly made to a possible capability of combining of the teaching of this application with the teaching of an application filed at the same time by the same applicant (handrail for an escalator or a moving walkway). There, a handrail with material characteristics and safety characteristics which are improved further or more extensively, or more or multiply improved, is disclosed.

BRIEF DESCRIPTION OF THE DRAWINGS

The invention is explained in more detail symbolically and by way of example on the basis of figures.

The figures are described conjunctively and generally. The same reference numerals signify the same components and reference numerals with different indices indicate functionally equivalent or similar components.

Preferred exemplifying embodiments of the invention are explained in more detail in the following description by way of the accompanying drawings, in which corresponding elements are provided with corresponding reference numerals and in which:

FIG. 1 shows a schematic illustration of a grip element in a perspective view in correspondence with a first exemplifying embodiment of the invention;

FIG. 2 shows the grip element, which is shown in FIG. 1, in a detail sectional illustration along the section line denoted by II, but in a modified form of embodiment;

FIG. 3 shows the grip element, which is shown in FIG. 1, from the viewing direction denoted by III in correspondence with a third exemplifying embodiment of the invention;

FIG. 4 shows two grip elements, which are joined together, of a further embodiment of the invention from the plan view denoted by III; and FIG. 5 shows a schematic illustration of the grip element gap change in the handrail curve.

DETAILED DESCRIPTION OF PREFERRED EMBODIMENTS

Figure 1:
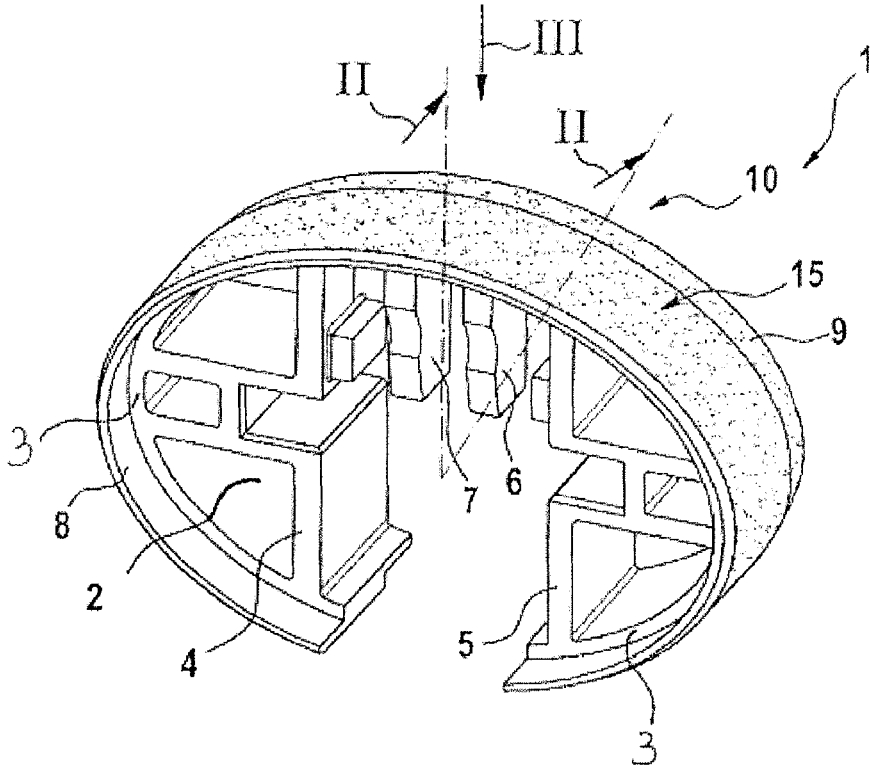

FIG. 1 shows a grip element 1 of a handrail in a perspective illustration in correspondence with a first exemplifying embodiment of the invention. The handrail comprises a plurality of grip elements 1 or 1' which are joined together, as is illustrated by way of the grip elements 1 or 1' in FIG. 4. The handrail composed of a plurality of grip elements 1 is particularly suitable for escalators or moving walkways. However, the handrail according to the invention can also be used for other applications.

The grip element 1 comprises a base body 2. The base body 2 comprises an outer shell 3 or cover layer 3 or casing 3 and stiffening ribs 4 and 5 arranged within the outer shell 3 or cover layer 3 or casing 3, wherein for clarification of the illustration only the stiffening ribs 4 and 5 are characterised in FIG. 1. Also illustrated are bearing pins 6 and 7 by which the grip element 1 engages in a traction means 12 (see FIG. 5), particularly a chain or a belt.

Figure 4:
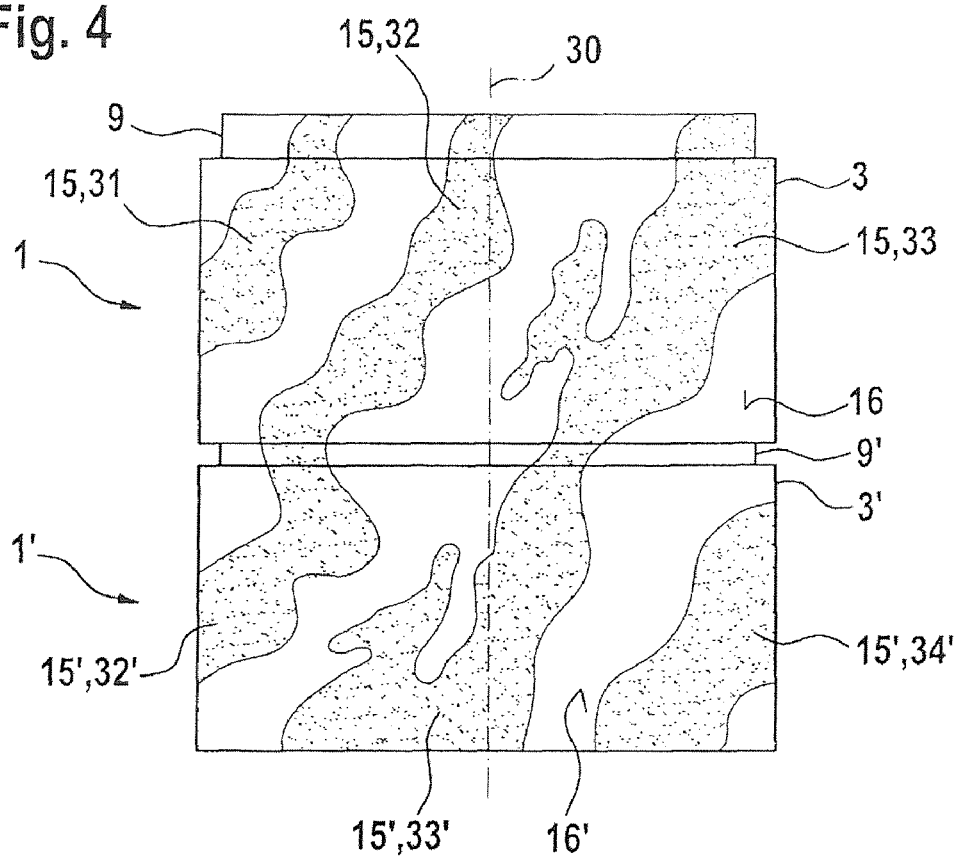

The outer shell 3 or cover layer 3 or casing 3 has on one side an inwardly disposed bevel 8 or recess 8 and on an opposite side an outwardly disposed bevel 9 or recess 9. The bevels 8 and 9 or recesses 8 and 9 enable pushing of grip elements 1 and 1' into one another, as is illustrated in FIG. 4. In that case, the grip elements 1 and 1' can tilt relative to one another to some degree.

The grip element 1 has a grip region 10 at which users of the escalator, moving walkway or the like hold during use of the handrail. The users thus grip the grip element 1 substantially within the grip region 10. As a result, dirt, ice, sand, dust, soil, chemicals, food residues and moisture can get onto the outer shell 3 or cover layer 3 or casing 3. Moreover, environmental influences act on the grip element 1. In the case of use outside, for example, rain, ice, sand, road grit, gravel, soil, chemicals, food residues and dust can get onto the outer shell 3 or cover layer or casing 3. The grip element 1 is thereby exposed, in travel operation, to chemical and mechanical actions and loads.

The outer shell 3 or cover layer 3 or casing 3 of the grip element 1 is, in this exemplifying embodiment, provided or coated at least substantially completely with a metallic coating 15. The coating 15 is in that case formed as a single layer and applied directly to an outer surface 16 (FIG. 2) of the outer shell 3 or cover layer 3 or casing 3. The coating 15 can, however, also consist of several layers. The coating 15 can also extend to the outwardly disposed bevel 8 or recess 9 of the outer shell 3. An additional protection or abrasion protection relative to wear in operation is thereby also provided in the region of the grip elements 1 and 1' working against one another.

Figure 2:
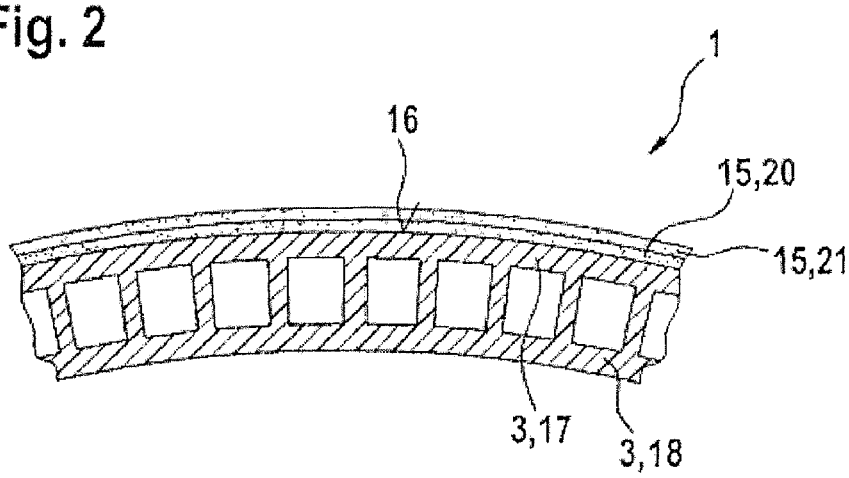

FIG. 2 shows the detail, which is denoted in FIG. 1 by II, of a grip element 1 in a schematic sectional illustration in correspondence with a second exemplifying embodiment of the invention. In this exemplifying embodiment the outer shell 3 or cover layer 3 or casing 3 has an outer wall 17 and an inner wall 18. The outer shell 3 or cover layer 3 or casing 3 is thus of double-wall construction in this exemplifying embodiment. A certain degree of elasticity of the outer wall 17 can thereby be achieved in order to prevent, in a given case, cracking or dropping off or detaching of the coating. The coating 15 can comprise a carrier layer 20 and top layer 21 applied to the carrier layer 20. In that case, however, still further layers which form intermediate layers and multiple layers can be provided. Moreover, the carrier layer 20 and/or the top layer 21 can also be built up in steps from a plurality of part layers. For example, the method procedure for application of the carrier layer 20 can be changed after application of a part layer if this is or appears expedient.

Specifically, the outer surface 16 of the outer shell 3 or cover layer 3 or casing 3 of the grip element 1 can be etched in a chromium-sulphuric acid solution and subsequently activated or seeded or coated with a noble metal, for example with palladium. A chemical nickel coating can subsequently be reductively deposited on the outer surface 16, whereby a part layer arises. It is then advantageous if this part layer of the carrier layer 20 is built up further in that a strike nickel or adhesion nickel as a guide promoter is deposited by electrolysis. The top layer 21 is applied in continuation or at the process conclusion.

Reliable protection of the outer shell or cover layer or casing 3 of the base body 2, in particular in the grip region 10, is guaranteed by the metallic coating 15.

Figure 3:
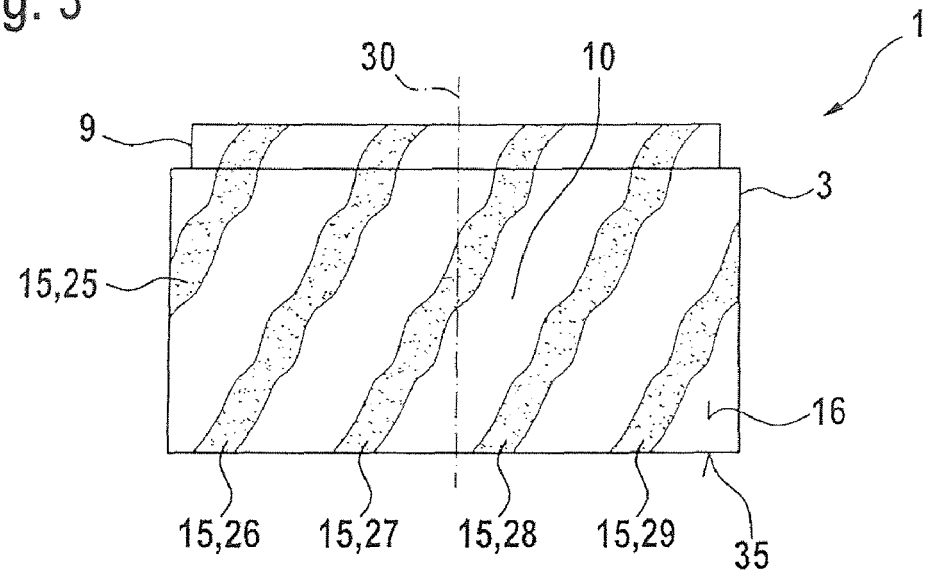

FIG. 3 shows a grip element 1 from the viewing direction, which is denoted in FIG. 1 by III, in a schematic illustration in correspondence with a third exemplifying embodiment of the invention. In this exemplifying embodiment the metallic coating 15 is applied only partly to the outer surface 16 of the outer shell 3 or cover layer 3 of the grip element 1. The coating 15 can in that case be formed in the shape of strips 25, 26, 27, 28, 29. The strips 25 to 29 in that case extends spirally or obliquely or helically about a longitudinal axis 30 of the grip element 1. The longitudinal axis 30 then lies in the direction of movement of the grip element 1. Through the possible or feasible strip-shaped form of the coating 15 an additional contour or level increase with elevations at the strips 25 to 29 and intermediate depressions at the outer surface 16 is created, which makes possible advantageous gripping and/or a firm handhold or holding in the grip region 10. Excellent insulation as well as improved haptics and/or enhanced gripability are thereby produced.

Moreover, a multi-layered construction can also be selected. In particular, the outer surface 16 can initially be coated with a carrier layer 20 and/or top layer 21 as is illustrated in FIG. 2. An extensive protection of the outer shell 3 or cover layer 3 or casing 3 is thereby made possible. In one possible embodiment the strip-shaped coating 15 illustrated in FIG. 3 can then be applied to the carrier layer 20 as top layer 21. In a further exemplifying embodiment the sequence is reversed, the carrier layer 20 receiving the strip-shaped coating 15 illustrated in FIG. 3 and the top layer 21 being applied above or on top.

FIG. 4 shows grip elements 1 and 1' which are placed against one another or inserted in one another. In that case the grip element 1 is placed by its internally disposed bevel 8 or recess 8 on an outwardly disposed bevel 9' or recess 9' of the grip element 1'. The grip element 1 has a partly coated outer surface 16 of the outer shell 3 or cover layer 3 or casing 3. The coating 15 is in that case formed to be strip-shaped and/or marbled. The strips 31, 32, 33 of the coating 15 of the grip element 1 extend approximately spirally or obliquely or in marble shape with respect to a longitudinal axis 30. Moreover, the grip element 1' additionally has a partly coated outer surface 16' of the outer shell 3' or cover layer 3' or casing 3'. In this connection, further strips 32', 33', 34' are provided. The form of the coating 15' at the grip element 1' is matched to the form of the coating 15 of the grip element 1 and/or continues the form of the coating. Specifically, the strip 32' of the coating 15' of the grip element 1' is connected with the strip 32 of the coating 15 of the grip element 1. In addition, the strip 33' of the coating 15' is connected with the strip 33 of the coating 15. A harmonious overall impression of the mounted or assembled or joined-together handrail thus results. Moreover, additional grip elements can be provided, the coating of which is similarly formed so that these additional grip elements are matched to the grip elements 1 and 1' and/or are in agreement or are the same or equivalent. As a result, an elegant or a uniform or balanced appearance is given. In addition, useful and appropriate haptics are imparted.

Figure 5:
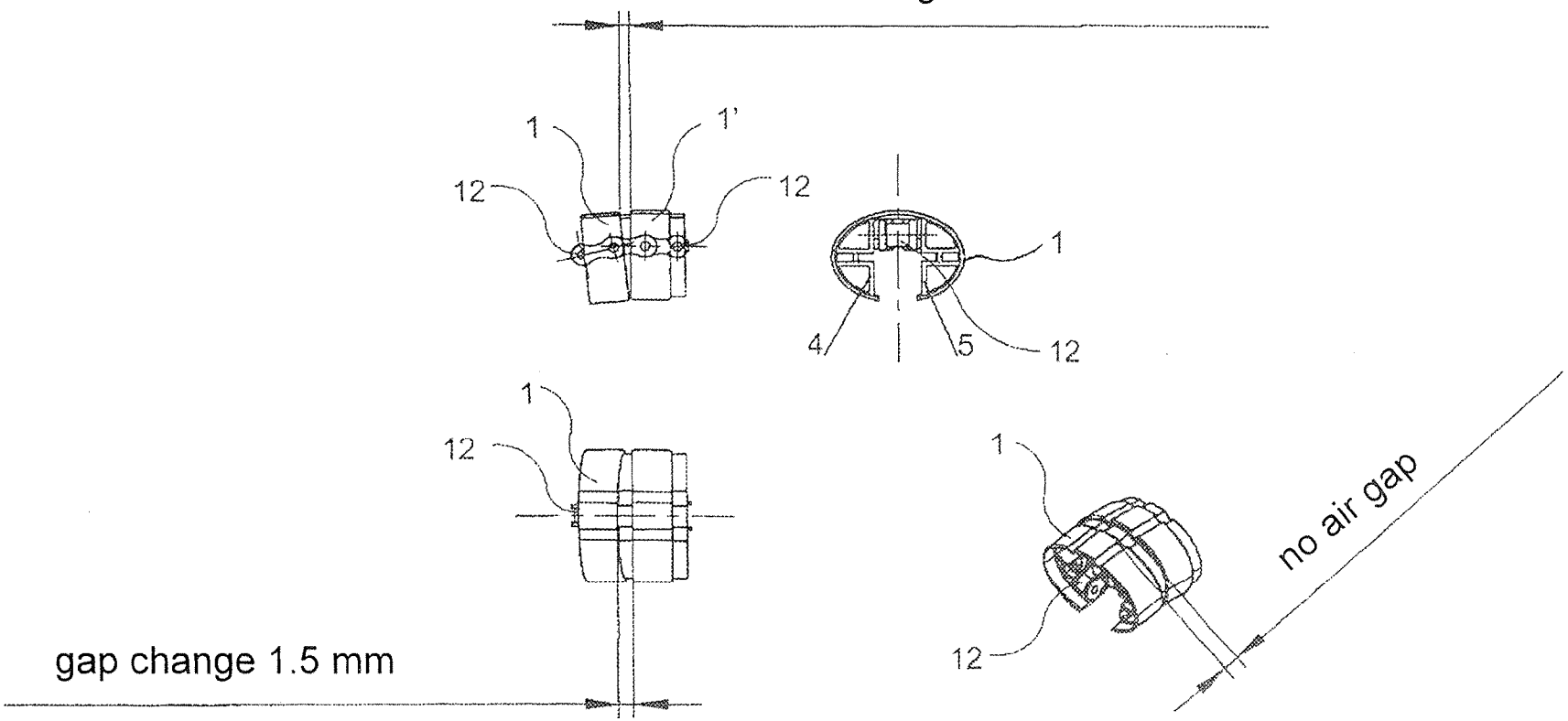

FIG. 5 shows the tilt change of the individual grip elements 1, 1' in the handrail curve. The angle deviation over the deflection curve of the grip elements 1, 1' allows a movement change or spacing change of at most 1.5 millimetres to 2 millimetres, i.e. the grip element gap change is at most 1.5 millimetres to 2 millimetres and the overlap region of the grip elements 1, 1' is dimensioned sufficiently at 3 millimetres to 5 millimetres. Moreover, no kind of air gap or opening gap arises, so that there is no risk of catching or pinching. The traction means 12 is constructed to be flexible or resilient or articulated (for example as illustrated in the form of a chain) in such a manner that an angle change or a change in spacing in the curved region or deflection region is possible easily, readily and simply. The necessary fixing or fastening of the individual grip elements 1, 1' on or with traction means 12 is very satisfactorily provided by the corresponding mount. An additional securing of the grip elements would be possible and conceivable, but can be omitted.

Due to this construction of the grip elements, it is also not possible for the grip elements to experience a resilient change in shape in the curve region, so that the coating does not undergo any deformation at that price.

The invention claimed is:

1. A handrail, comprising: a plurality of grip elements, each grip element comprising an outer shell having a grip region, the grip element being at least partly coated with an applied coating at least partly in the grip region, the coating comprising at least one layer of at least one of a metal and a metal compound, the grip elements having ends constructed such that a first end of a first grip element can be mated with a second end of a second, adjacent grip element such that the first and second grip elements are tiltable relative to each other.

2. A handrail according to claim 1, wherein the first end of each grip element has an inwardly disposed bevel or recess, and the second end has an outwardly disposed bevel or recess.

3. A handrail according to claim 1 or 2, wherein the coating fully covers the grip region.

4. A handrail according to claim 1 or 2, wherein the outer-shell is of a double-wall construction with an outer wall and an inner wall.

5. A handrail according to claim 1 or 2, wherein the coating comprises at least one carrier layer applied to an outer surface of the outer shell and at least one top layer applied over the carrier layer.

6. A handrail according to claim 5, wherein at least the carrier layer is applied by plating the outer surface.

7. A handrail according to claim 5, wherein at least one of the carrier layer and top layer is applied by reductive or electrolytic deposition.

* * * * *